US005651714A

United States Patent [19]

Remken

[11] Patent Number: 5,651,714

[45] Date of Patent: Jul. 29, 1997

[54] TOY WITH REVOLVING VEHICLE

[76] Inventor: Petrus Wilhelmus Anthonius Remken, Meentweg 2A, 1405 JA Bussum, Netherlands

[21] Appl. No.: 453,893

[22] Filed: May 30, 1995

[30] Foreign Application Priority Data

Feb. 5, 1995 [NL] Netherlands ..... 9500206

[51] Int. Cl.[6] ..... A63H 33/26; A63H 18/00

[52] U.S. Cl. ..... 446/136; 446/444

[58] Field of Search ..... 446/136, 135, 446/134, 133, 129, 444

[56] References Cited

U.S. PATENT DOCUMENTS

| | | | |
|---|---|---|---|
| 2,452,939 | 11/1948 | La Forge | 446/135 |
| 2,818,680 | 1/1958 | Borsos | 446/135 |
| 2,870,550 | 1/1959 | Decker | 446/135 X |
| 4,757,986 | 7/1988 | Hwang et al. | 446/136 X |
| 4,917,644 | 4/1990 | Sunshine | 446/129 X |
| 4,937,207 | 6/1990 | Simmell et al. | 446/444 X |
| 5,540,187 | 7/1996 | Udelle et al. | 446/136 X |

*Primary Examiner*—Robert A. Hafer
*Assistant Examiner*—D. Neal Muir
*Attorney, Agent, or Firm*—Young & Thompson

[57] ABSTRACT

A toy with revolving vehicle comprises a cylindrical housing (1) in which a drive (4 to 10) for a miniature vehicle (20) is accommodated so as to move the vehicle (20) repeatedly over the outer wall (2) of the housing (1). The drive (4 to 10) for this purpose generates a magnetic field which rotates about a centerline (3) of the housing at least during operation, which field permeates the housing wall and is capable of applying itself to a permanent magnet (21) present in the miniature vehicle (20).

5 Claims, 1 Drawing Sheet

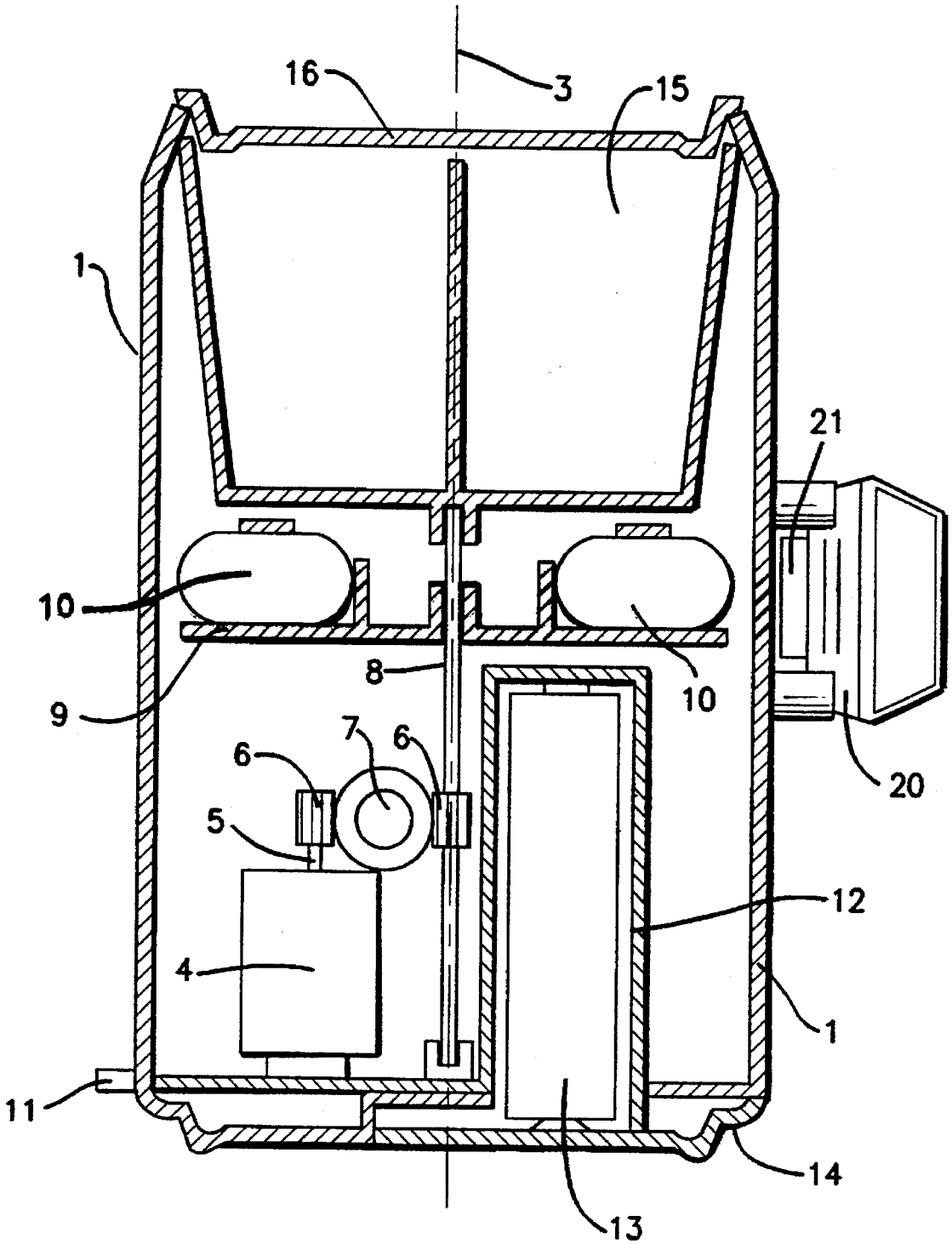
16
3
15
1
21
10
10
8
9
7
6
6
5
20
12
4
1
11
14
13

TOY WITH REVOLVING VEHICLE

FIELD OF THE INVENTION

The invention relates to a toy with a revolving vehicle, comprising a path for the miniature vehicle, the latter being provided with driving means for repeatedly traveling over said path.

BACKGROUND OF THE INVENTION

A toy of the kind mentioned in the opening paragraph is very popular with children, although also adults can be fascinated by it. In a known toy, the path is usually built up from a number of separate path sections which are provided with suitable guides for the vehicle. The guide also often comprises an electrical contact track which is coupled to an electric motor accommodated in the vehicle, at least during operation, via a sliding contact or conductive brush of the vehicle A disadvantage of such a toy is that it is to be assembled anew each time and occupies comparatively much space, while the electrical contact track for the vehicle will always be subject to wear. In addition, vehicles used in the known toy track are usually rather expensive owing to their integrated electronics and electric motors.

OBJECT OF THE INVENTION

The invention has for its object inter alia to provide a toy of the kind mentioned in the opening paragraph which does not have the above disadvantages, or at least has them to a considerably lesser degree.

SUMMARY OF THE INVENTION

According to the invention, a toy of the kind mentioned in the opening paragraph is for this purpose characterized in that the path is formed by the outer wall of a cylindrical housing, and in that the driving means are accommodated in the housing and generate a magnetic field which rotates, about a centerline of the housing at least during operation, which field is capable of applying itself to a permanent magnet placed in the miniature vehicle. The vehicle is driven as well as guided by the rotating magnetic field in such a toy. As a result, the miniature vehicle need not comprise driving means and need only be fitted with a permanent magnet, which substantially reduces its cost price. Moreover, there is no physical contact required between the vehicle and an electrical contact track, so that the toy track according to the invention will be less prone to wear.

A special embodiment of the toy track according to the invention is characterized in that the driving means comprise an arm provided with a permanent magnet at each end and placed at least substantially with its mass center on a drive shaft which coincides with the centerline of the housing and which is in engagement with an output shaft of an electric motor which is also accommodated im the housing. The rotating magnetic field is thus realized in a comparatively simple, mainly mechanical way. Two miniature vehicles can be driven simultaneously by the arm, one at either end. To have more vehicles circulate at the same time and cover different paths, a further special embodiment of the toy track according to the invention is characterized in that the drive shaft has a number of arms at different levels, each arm being provided with permanent magnets at its ends.

To increase the attractiveness of the device according to the invention, a further special embodiment of the toy track according to the invention is characterized in that the means for generating a rotating magnetic field are coupled to a sound generator. The sound generator may generate e.g. motor noises which are audible while the vehicles are making their rounds.

A particularly practical embodiment of the toy according to the invention is characterized in that the housing is further provided with a compartment for supply batteries which is manually accessible and with a miniature vehicle storage space which is manually accessible. The cylindrical housing in this case offers not only a racetrack for the vehicle and space for the driving means, but also a space for an electrical supply and a storage compartment for the miniature vehicle when the racetrack is not in use. In fact, all accessories necessary or desirable for operating the toy track can be accommodated in the cylindrical housing, whereby a particularly compact, user-friendly unit is created which is fully portable and which can function independently of external additional means.

Within the scope of the invention, the term "vehicle" should be given a wide interpretation and is by no means limited to automobiles. In particular, the miniature vehicle may comprise besides a model car, also a model train or miniature ball.

In more general terms, the invention offers a highly compact and user-friendly model for any rotating object, whatsoever which is generally regarded as particularly attractive. The invention thereby provides first and foremost a children's toy item, but it may alternatively be used for a plurality of promotional applications, for which purpose the outer wall may be imprinted as desired.

The invention will now be explained in more detail with reference to an embodiment and an accompanying drawing, in which:

FIG. 1 is a cross-section of an embodiment of the toy according to the invention.

It is noted that the drawing is purely diagrammatic and not necessarily drawn to scale. Some dimensions may have been particularly exaggerated for greater clarity. Corresponding parts have been given the same reference numerals in the drawing as much as possible.

The toy of FIG. 1 comprises a cylindrical housing 1 of extruded aluminum or a suitable synthetic resin material which tapers slightly inward at the top and at the bottom so as to approximate as much as possible the shape of a soft drink or beer can of the type usual nowadays. With a suitable artwork on the outer wall 2 of the housing 1, the device can very well be used for promotional actions in this field.

The housing comprises driving means for generating the magnetic field which rotates about a centerline 3 of the housing during operation. The driving means in this example comprise an electric motor 4 whose output shaft 5 is coupled to a central drive shaft 8 via gears 6 and wormwheel 7, said shaft 8 engaging substantially the mass center of an arm 9 which carries permanent magnets 10 at its ends. An externally accessible switch 11 is provided for operating the electric motor. The housing further comprises, outside the plane of drawing, a sound generator which is coupled to the electric motor and which can generate appropriate (motor) noises during operation. Two operational modes may be selected with the switch 11, i.e. with and without sound. The housing is further provided with a compartment 12 for a battery supply 13 which is accessible from the lower side through a lid.

To start the device, a miniature vehicle 20 is placed against the outer wall 2 of the housing 1 in the magnetic field of one of the magnets 10 on arm 9. The device is then switched to one of the operational modes with the switch i 1 whereby the electric motor 4 drives the central shaft 8, and the arm 9 with the permanent magnets 10 will perform a rotary movement around the centerline 3 of the housing 1. The vehicle 20 is provided with a permanent magnet 21 and will accordingly be attracted and dragged along by the permanent magnet 10 of the arm 9. The vehicle will thus perform a repeated circular movement over the wall 2 of the housing. The vehicle is contactlessly guided and driven, so that wear is minimized.

After use the vehicle 20 may be stored in a manually closable compartment 15 which the single figure is provided in the housing for this purpose and which is accessible at the upper side thereof via a lid 16.

Although the invention was explained above with reference to only a single embodiment, it will be obvious that the invention is by no means limited to the example given. On the contrary, many more variations and designs are possible to those skilled in the art within the scope of the invention. Thus the rotating magnetic field may be generated not by the electromechanical means described above but by alternative, fully electronic means, whereby the number of moving parts, and thus the sensitivity to wear of the device, are further reduced.

Instead of a model car, furthermore, any other object may be driven over the outer wall of the housing. As a promotional item in (soccer) football events, for example, a rolling mini-bail could be used as the vehicle. It is also possible to move a number of vehicles simultaneously instead of a single vehicle. The arm of the embodiment is indeed capable of driving two vehicles, but this number may be increased at will in that more arms are placed on the central drive shaft at different levels.

In more general terms, the invention always offers a particularly user-friendly, compact toy track which is subject to little wear and which is highly suitable for use as a toy and for promotional activities, in which case the outer wail is provided with a suitable attractive artwork.

I claim:

1. A toy comprising a miniature vehicle and a track for said miniature vehicle, the vehicle being provided with driving means for repeatedly travelling over said track and containing a permanent magnet, the track comprising a cylindrical housing having an outer wall, the driving means being accommodated entirely inside the housing and generating a magnetic field which rotates about a centerline of the housing during operation, which field applies itself to the permanent magnet in said miniature vehicle to cause the vehicle to revolve about the housing, wherein the housing is provided with a compartment that is manually accessible for the storage of said miniature vehicle, said compartment having a removable top wall and a fixed bottom wall, said drive means comprising a drive shaft which lies on the centerline of the housing and which is in engagement with an output shaft of an electric motor which is also accommodated in the housing, one end of said drive shaft being rotatably received within said bottom wall of said miniature vehicle storage compartment.

2. A toy as claimed in claim 1, wherein the driving means comprise an arm provided with a permanent magnet at each end and placed at least substantially with its mass center on a drive shaft which coincides with the centerline of the housing and which is in engagement with an output shaft of an electric motor which is also accommodated in the housing.

3. A toy as claimed in claim 1, wherein the housing is further provided with a compartment for a supply battery which is manually accessible and with a miniature vehicle storage space which is manually accessible.

4. A toy as claimed in claim 1, wherein the vehicle comprises a model car.

5. A toy as claimed in claim 1, wherein the housing simulates a beverage can.

* * * * *